United States Patent [19]

DeFord

[11] Patent Number: 4,545,501

[45] Date of Patent: Oct. 8, 1985

[54] GARBAGE CAN LID RETAINER

[76] Inventor: Daniel DeFord, 13131 Brimhall Rd., Bakersfield, Calif. 93300

[21] Appl. No.: 667,427

[22] Filed: Nov. 1, 1984

[51] Int. Cl.[4] ..... B65D 45/00

[52] U.S. Cl. ..... 220/318

[58] Field of Search ..... 220/315, 318, 1 T; 292/288

[56] References Cited

FOREIGN PATENT DOCUMENTS 559138 2/1975 Switzerland ..... 220/318

*Primary Examiner*—George T. Hall

*Attorney, Agent, or Firm*—Julius Rubinstein

[57] ABSTRACT

The garbage can lid retainer is formed from a resilient strip of material to which are attached nonresilient strips at opposite ends. The nonresilient strips are provided with snap means for forming loops on each end of the resilient strip. These loops can be interlocked with the garbage can handles, and the resilient strip is sized so when the loops are attached to the handles of the garbage can, the resilient strip can be pulled over the garbage can lid to hold the lid on the garbage can.

3 Claims, 5 Drawing Figures

FIG. 1.
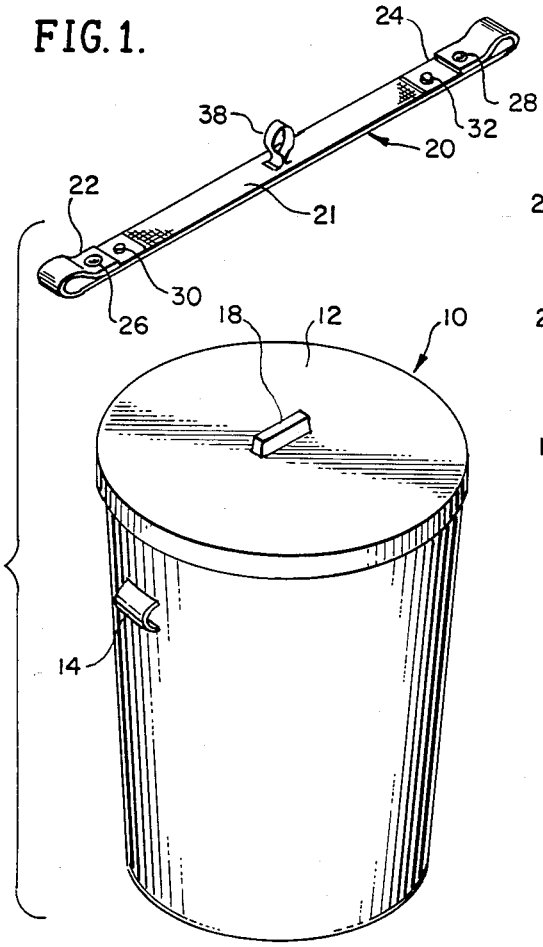
FIG. 2.
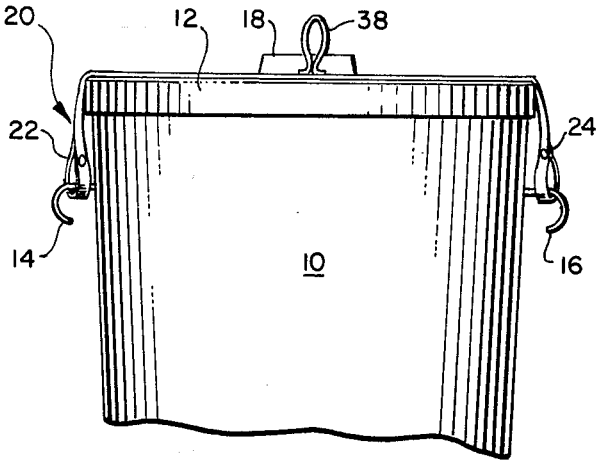
FIG. 3.
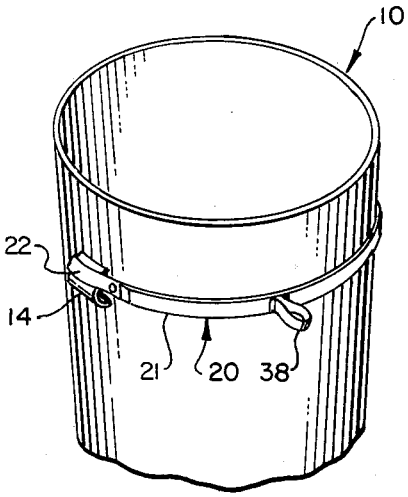
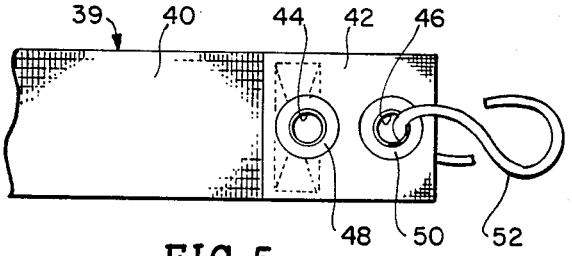
FIG. 5.
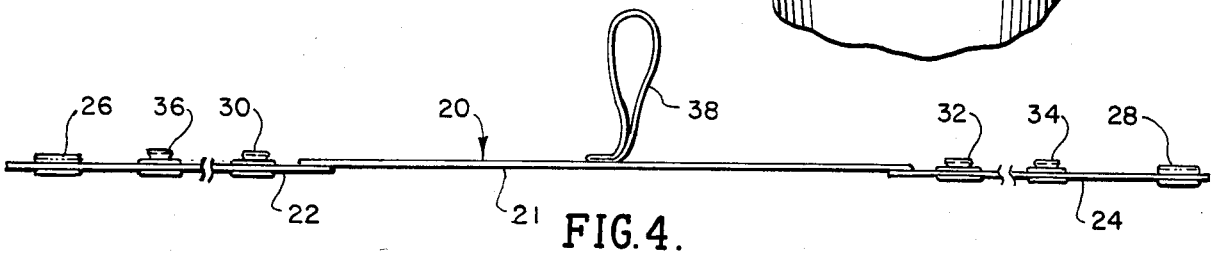
FIG. 4.

GARBAGE CAN LID RETAINER

This invention relates generally to garbage can lids, and more particularly to a device for holding a garbage can lid on a garbage can.

STATEMENT OF PROBLEM AND PRIOR SOLUTIONS

Animals, particularly those living near residences, utilize garbage from garbage cans as a source of food. To gain access to the food in the garbage cans, the animals may tip the garbage can over and scatter garbage around the area of the garbage can. This attracts vermin. Garbage can lids or covers have not proven to be an obstacle to animals, such as dogs, cats or coyotes, because they are strong enough to dislodge the cover.

It is not difficult to think of ways to retain a garbage can lid on te carbage can to prevent access to the contents of the can by animals. However, it is difficult to devise a solution to this problem which does not require specially constructed machine parts, which does not require expensive machine tools for its manufacture, and which can be made easily and cheaply.

A measure of the difficulty involved in arriving at such a solution can be had by reference to prior attempts to solve this problem. The patents to Shettler, U.S. Pat. No. 2,998,276; Geldart, U.S. Pat. No. 3,124,381; Williams, U.S. Pat. No. 3,589,760; Spellman, U.S. Pat. No. 4,095,830; and Murphy, U.S. Pat. No. 4,241,846, all required comparatively expensive machine tools for the construction of the lid retainer and they use comparatively expensive parts. Consequently, the sale price of the lid retainers previously constructed had to be high, and this was an obstacle to their widespread use.

What is needed and comprises an important object of this invention is to provide a garbage can lid retainer which is simple to construct, requires no expensive machine parts, and which does not require expensive machine tooling for its construction.

This and other objects of this invention will become more apparent when better understood in light of the accompanying specification and drawing.

FIG. 1 is a perspective exploded view of a garbage can and lid with the improved garbage can lid retainer over the lid on the can.

FIG. 2 is a side elevational view of the improved garbage can lid retainer with the lid retainer on the garbage can cover.

FIG. 3 is a perspective view of the improved garbage can lid retainer mounted on the can with the lid removed, showing the lid retainer embracing the circumferential surface of the side of the garbage can.

FIG. 4 discloses means for adjusting the tension in the garbage can lid retainer so it can be used with different sized garbage cans, or to compensate the garbage can lid retainer for any decreased resilience in the material forming the lid retainer.

FIG. 5 discloses a partial perspective view of a modified garbage can lid retainer disclosing another way of connecting the ends of the garbage can lid retainer to the handles of the garbage can.

Referring now to FIG. 1 of the drawing, a garbage can indicated generally by the reference number 10 is provided with a cover or lid 12. The garbage can has a pair of ear-like handles 14 and 16 by which the garbage can can be conveniently carried. These handles 14 and 16 which may be in the shape of a loop are attached to the sides of the garbage can (see FIG. 1). The garbage can lid 12 is typically provided with a centrally disposed carrying handle 18.

The improved garbage can lid retainer 20 is formed from any suitable elastic fabric, and is in the shape of an elongated narrow strip 21. Narrow strips 22 and 24, smaller than strip 21, and formed from a nonelastic fabric, are secured by any suitable means, such as gluing or sewing to the opposite ends of the strip 21 (see FIG. 2). Pairs of female snaps 26 and 28 are secured by any suitable means to the remote ends of strips 22 and 24. One or more pairs of mating male snaps 30 and 32, and 34 and 36, are secured in linearly spaced relationship to the opposite ends of strips 22 and 24 (see FIG. 4). A handle 38, formed from any suitable fabric, is secured by any suitable means in the center of the elongated strip 21.

In use, the ends of the strips 20 and 24 are folded against each other so that the female snap 26 makes with male snaps 30 or 36, and female snap 28 mates with male snaps 32 or 34 to form closed loops which can be interlocked with the garbage can handles 14 and 16. Then, with the garbage can lid on the garbage can, the handle 38 of the strip 21 is grasped, and the strip 21 is pulled over the top surface of the lid to hold the lid on the garbage can (see FIG. 2). When the lid is to be removed from the garbage can, the lid retainer is pulled to the side of the garbage can where it snuggly embraces the circumferential of the garbage can, in a position where it cannot be pulled off the garbage can and become lost, and where it is not likely to snag on anything when the garbage can is being moved (see FIG. 3).

In the event the elastic strip 21 stretches, or in the event the lid retainer is used with a smaller diameter garbage can and lid, the additional pair of male snaps 34 and 36 provide a simple way to vary the length of the lid retainer.

The modified garbage can lid retainer 39 shown in FIG. 5 differs from the embodiment shown in FIG. 1 in that the nonelastic strips 42 attached to the ends of the elastic strip 40 are provided with two linearlly spaced holes 44 and 46 surrounded by metal reinforcing rings 48 and 50. A generally S-shaped hook 52 is connected to one or the other of the holes 44 or 46 as shown in FIG. 5 depending on the required length of the garbage can lid retainer. And the opposite end of the hook 52 is adapted to be connected to the handles of the garbage can. The two holes 44 and 46 in the nonelastic strips 42 at each end of the elastic strip 40 provide means for varying the effective length of the garbage can lid retainer for the reasons described above.

Having described the invention, what I claim is new is:

1. A garbage can lid retainer for retaining a cover on a garbage can where the garbage can is provided with a pair of handles, said lid retainer comprising a narrow strip of elastic fabric adapted to engage the top surface of the lid, narrow strips of non-elastic fabric secured to the opposite ends of said strip of elastic fabric, the width of the strips of said non-elastic fabric not greater than the width of said elastic fabric whereby the garbage can lid retainer can be compactly rolled-up for storage, means attached to said strips of non-elastic fabric for releaseable attachment to said handles on said garbage can and for varying the effective length of the garbage can lid retainer whereby the garbage lid retainer can be releaseably attached to said handles, the length of said flexible strip selected so when said strip of elastic fabric engages the top surface of said lid and the strips of non-elastic fabric are attached to the handles of the garbage can, the lid of the garbage can will be retained on the garbage can with sufficient force to hold the lid on the can against efforts of animals to dislodge the lid, and a handle formed from fabric, the width of said handle not greater than the width of said narrow strip of elastic fabric for compactness in storage when the garbage can lid retainer is rolled-up, said handle secured to the center part of said narrow strip of elastic fabric whereby the garbage can lid retainer can be pulled over the lid until it embraces the side of the garbage can in a convenient location when the lid of the garbage can is removed.

2. The garbage can lid retainer described in claim 1 wherein said means attached to said strips of non-elastic fabric for releaseable attachment to the handles of the garbage can and for varying the length of the garbage can lid retainer comprise pairs of snaps on at least one of the strips of non-elastic fabric for varying the size of the loops whereby the effective length of the garbage can lid retainer can be adjusted.

3. The garbage can lid retainer described in claim 1 wherein said means attached to said strips of non-elastic fabric for releaseable attachment to the handles of the garbage can and for varying the length of the garbage can lid retainer comprise a plurality of holes in at least on of the non-flexible strips, a hook, one part of the hook releaseably attached to one of said holes, the other part adapted to be attached to a handle on the garbage can, whereby the garbage can lid retainer can be releaseably attached to said garbage can and the effective length of the garbage can lid retainer can be varied by selecting the hole that said one part of the hook is attached to.

* * * * *